US008384564B2

(12) United States Patent
Swope, III et al.

(10) Patent No.: US 8,384,564 B2
(45) Date of Patent: Feb. 26, 2013

(54) METHOD AND SYSTEM FOR ADDING GADGETS TO A TRAFFIC REPORT

(75) Inventors: Howard M. Swope, III, Exton, PA (US); Margaret M. Cronan, Newtown, PA (US); Jennifer Colleran, Admore, PA (US); Michael H. Nymark, Gilbertsville, PA (US); Michal Balcerzak, Philadelphia, PA (US); Robert M. Soulchin, King of Prussia, PA (US)

(73) Assignee: Navteq B.V., Veldhoven (NL)

( * ) Notice: Subject to any disclaimer, the term of this patent is extended or adjusted under 35 U.S.C. 154(b) by 1027 days.

(21) Appl. No.: 12/399,763

(22) Filed: Mar. 6, 2009

(65) Prior Publication Data

US 2010/0225504 A1 Sep. 9, 2010

(51) Int. Cl.
*G08G 1/123* (2006.01)

(52) U.S. Cl. ..... 340/995.13; 340/539.1; 340/988; 340/990; 701/117; 701/439

(58) Field of Classification Search ..... 340/995.13, 340/539.1, 990, 995.1, 988; 701/117, 439
See application file for complete search history.

(56) References Cited

U.S. PATENT DOCUMENTS

| | | | | |
|---|---|---|---|---|
| 5,838,315 | A | 11/1998 | Craycroft et al. | 345/333 |
| 7,116,326 | B2 | 10/2006 | Soulchin et al. | 345/440 |
| 7,203,595 | B1 | 4/2007 | Auxer et al. | 701/117 |
| 7,221,287 | B2 * | 5/2007 | Gueziec et al. | 340/995.24 |
| 7,765,055 | B2 * | 7/2010 | Cera et al. | 340/995.13 |
| 7,783,990 | B2 * | 8/2010 | Amadio et al. | 715/809 |
| 7,835,858 | B2 * | 11/2010 | Smyth et al. | 701/439 |
| 8,190,362 | B2 * | 5/2012 | Barker et al. | 701/414 |
| 2003/0040868 | A1 * | 2/2003 | Fish et al. | 340/995 |
| 2003/0170004 | A1 | 9/2003 | Komaromi | 386/69 |
| 2004/0143385 | A1 | 7/2004 | Smyth et al. | 701/117 |
| 2006/0247850 | A1 | 11/2006 | Cera et al. | 701/208 |
| 2007/0061488 | A1 * | 3/2007 | Alagappan et al. | 709/246 |
| 2007/0139430 | A1 * | 6/2007 | Korn et al. | 345/581 |
| 2007/0198946 | A1 | 8/2007 | Viji et al. | 715/779 |
| 2007/0219938 | A1 | 9/2007 | Boersma et al. | 707/1 |
| 2007/0226734 | A1 | 9/2007 | Lin et al. | 717/177 |

* cited by examiner

*Primary Examiner* — Eric M Blount

(57) ABSTRACT

A method and system for adding traffic gadgets to a traffic report is disclosed. A traffic gadget is a dynamic object defined by a relatively small code module that is separate from the main traffic report application code. A programmer develops the traffic gadget's visual functionality and specifies the type of data that the traffic gadget can receive. An artist configures the visible appearance of the traffic gadget for a specific end-user application. The end-user may then select a traffic gadget and add the selected traffic gadget to a visual traffic report. The user may also select data to control the functionality of the traffic gadget during the traffic report.

20 Claims, 16 Drawing Sheets

METHOD AND SYSTEM FOR ADDING GADGETS TO A TRAFFIC REPORT

FIELD

The present invention relates generally to providing traffic reports, and more particularly, relates to providing gadgets that a user can use to customize a traffic report.

BACKGROUND

Most drivers have been impacted by traffic delays. Traffic delays are caused by one or more traffic incidents, such as congestion, construction, an accident, a special event (e.g., concerts, sporting events, festivals), a weather condition (e.g., rain, snow, tornado), and so on. Many television stations provide a traffic report in their news reports to provide viewers with information regarding current traffic conditions. Some television stations use graphics when presenting traffic information.

For example, U.S. Pat. No. 7,116,326, which is assigned to the same assignee of the present application, describes how a television station can display a traffic flow map that visually shows an animated graphic of the traffic conditions on one or more roadways in and around a metropolitan area. The traffic flow map is automatically generated from real-time traffic flow data and changes as the actual, current traffic conditions change.

In addition to the animated traffic flow graphics, the traffic report includes graphics for static objects that provide additional information to a viewer of a traffic report. For example, a road shield that identifies a road may be placed adjacent to the road in the traffic report. Street names, buildings, waterways, and so on may also be added to the traffic report to assist a viewer in recognizing the location described in the traffic report. These static objects do not change from traffic report to traffic report.

Additionally, the traffic report includes graphics for dynamic objects. Unlike the static objects, the dynamic objects can vary from traffic report to traffic report. One way in which the dynamic objects can vary is to change their visual characteristics. The visual characteristic changes may include changes to text characters, color, animation, texture, and so on.

The dynamic objects may be data driven or selected by the user. The dynamic objects are designed to receive a particular type of data, such as vehicle speed or travel times. As the data driving the dynamic object changes, the data presented by the dynamic object changes. For example, a dynamic object numerically depicting vehicle speed may show the speed increase or decrease by changing the text that is displayed as the traffic report is presented. The user may change the dynamic object characteristics manually for data that is more subjective and/or not supported by a data feed.

Another way in which dynamic objects vary is to change their location. The location information could be data driven. For example when the user requests an incident icon to be added to the traffic report, the system adds a dynamic object (the incident icon) at the data specified location, which corresponds to the real world location. Also, the system could allow a user to add an object at a user desired location. For example, the user may want to type in some text to draw attention to the traffic conditions or provide additional information at a user defined location. The location of this text object could vary from report to report depending on the conditions.

Additionally, a dynamic object can vary by whether or not the object is included in a traffic report. The fact that an object does not always exist in the virtual world is a characteristic of a dynamic object. The user may indicate whether to include a dynamic object in a traffic report based on the traffic information to be conveyed. For example, the user may include a traffic sensor speed dynamic object in a traffic report. As there are typically many sensors on a highway, the user selects a few representative sensors to provide data for the traffic sensor speed dynamic object.

The static and dynamic object graphics available to the traffic report are pre-configured in a traffic report installation configuration art file set. These configuration files define how the objects appear for a specific television station in the traffic report when a television producer or other user creates a map or graphic to include in a traffic report. The traffic report application code uses this configuration information to create the graphics for the traffic graphic or map, including the traffic flow graphics and the object graphics, and sends a video output signal to a television station for use in its traffic report.

While the animated traffic flow map with the object graphics allows a viewer to more easily comprehend the current traffic conditions, there continues to be room for new features and improvements in providing traffic reports. One area for improvement is increasing the flexibility of creating a traffic report. By allowing a television producer or other user to add traffic gadgets to the traffic flow map, the television producer has more control over what and how information is presented in a traffic report. As a result, the viewer of the traffic report may see a more dynamic and informative report of traffic conditions.

SUMMARY

A method and system for adding traffic gadgets to a traffic report is disclosed. A traffic gadget is a standardized dynamic object having dynamic features that the user can place in a virtual world presented in a traffic report. The dynamic features include dynamically changing the visual characteristics of the gadget and/or changing the textual data that is presented as the data driving the gadget changes. The gadgets are also dynamic in that they are optionally included and can be included in any location on any type of traffic report item (e.g., 2D map, 3D world, image background, full screen video, etc.). Gadgets are standardized in that a user interacts with all of the available gadgets in a similar fashion to perform functions, such as placing a gadget in a world and modifying gadget properties.

A traffic gadget is defined by a relatively small code module that is separate from the main traffic report application code. A gadget framework facilitates coding of additional gadgets according to a set of defined interfaces. Any number of traffic gadgets can be coded and added to a gadget set following the framework interface definitions. Furthermore, at runtime, the gadget framework provides a uniform set of user interface controls for the user to interact with all of the available gadgets. For example, the user selects the gadgets from a palette of gadgets and places them on the traffic visualization in a uniform way. Also, the user changes the runtime properties of the gadgets in a uniform way. Additionally, the gadget framework renders the visual appearance of the traffic gadget when it is displayed in the traffic report.

Prior to generating a traffic report, a programmer develops code for the basic capabilities of the traffic gadget. For example, the programmer may select the texture, color, illumination, position, text, and/or other features of the traffic gadget to dynamically change during a traffic report. As another example, the programmer may select one or more of traffic flow data, speed data, volume data, density data, travel time data, incident data, and so on that the traffic gadget can receive.

An artist then uses a graphics program to configure the traffic gadget usage for a particular television station. The artist configures the visible appearance of the traffic gadget and selects data to drive the gadget's dynamic functionality from the available data. Any number of gadgets can be configured for the television station's traffic report implementation.

With a user interface, a user, such as a television producer, selects one or more traffic gadgets to be used in the traffic report. In addition to selecting a traffic gadget, the user may also select what data to control the functionality of the traffic gadget. For example, if the traffic gadget has been designed to receive speed data, the user specifies that the traffic gadget uses the speed data from a specified point on a road. As a result, the user has more flexibility regarding what graphic objects to include in a traffic report.

These as well as other aspects and advantages will become apparent to those of ordinary skill in the art by reading the following detailed description, with reference where appropriate to the accompanying drawings. Further, it is understood that this summary is merely an example and is not intended to limit the scope of the invention as claimed.

BRIEF DESCRIPTION OF THE DRAWINGS

Presently preferred embodiments are described below in conjunction with the appended drawing figures, wherein like reference numerals refer to like elements in the various figures, and wherein.

DETAILED DESCRIPTION

I. Traffic Report System

Figure 1:
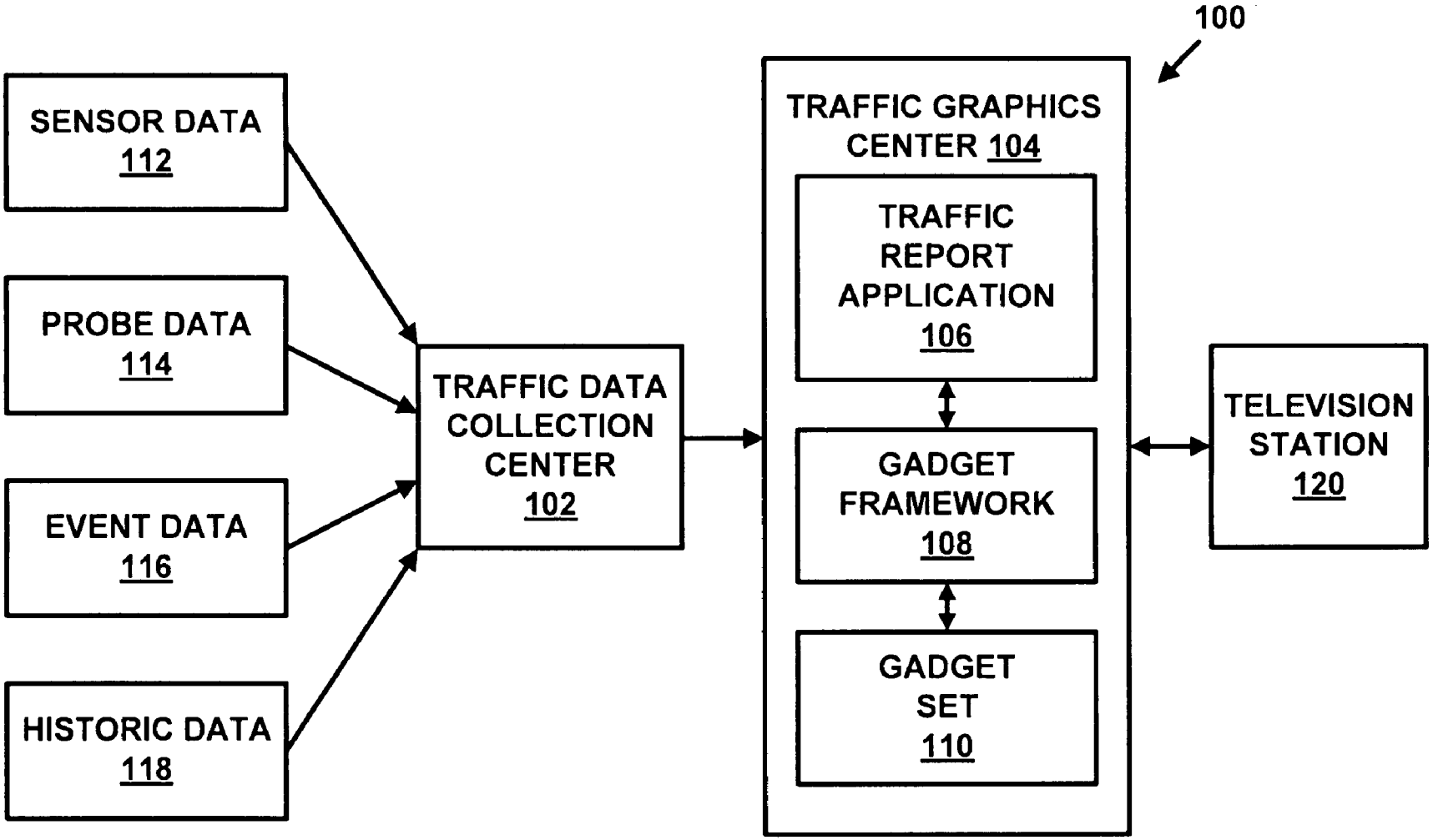
FIG. 1 is a block diagram of a system for providing a traffic report, according to an example.

FIG. 1 is a block diagram of a system 100 for providing a traffic report. The system 100 includes a traffic data collection center 102 and a traffic graphics center 104. The traffic data collection center 102 receives data regarding traffic conditions from a variety of sources and provides a traffic data output to the traffic graphics center 104. The traffic graphics center 104 uses the traffic data output along with user inputs to generate a video output that can be used by a television station 120 or other end user, such as a web-based application or a mobile application, to present information regarding current traffic conditions to viewers.

The traffic data collection center 102 receives sensor data 112, probe data 114, and/or event data 116. The sensor data 112 is data collected from roadway sensors. The sensors may use radar, acoustics, video, and embedded loops in the roadway to collect data that can be used to characterize traffic conditions. For example, the sensor data 112 may include speed, volume (number of vehicles passing the sensor per period of time), and density (percentage of the roadway that is occupied by vehicles). The sensor data 112 may include other data types as well, such as vehicle classification (e.g., car, truck, motorcycle). The sensor data 112 is generally collected in real time (i.e., as it occurs) or at near real time.

The probe data 114 is point data collected from a moving vehicle having a device that can identify vehicle position as a vehicle travels along a road network. For example, the device may use cellular technology or Global Positioning Satellite (GPS) technology to monitor the vehicle's position on the road network. By monitoring the vehicle's movement, the probe data 114 can be used to determine travel time, which can then be used to calculate speed of the vehicle. The probe data 114 is generally collected in real time or at near real time.

The event data 116 is traffic data regarding a traffic event. A traffic event is an occurrence on a road system that may impact the flow of traffic. Traffic events include incidents and weather. An incident is a traffic event that obstructs the flow of traffic on the road system or is otherwise noteworthy in reference to traffic. Example incidents include accidents, congestion, construction, disabled vehicles, and vehicle fires.

A traffic operator may enter the event data 116 into a Traffic Incident Management System (TIMS), such as the TIMS described in U.S. Patent Publication No. 2004/0143385, which is assigned to the same assignee as the current application. U.S. Patent Publication No. 2004/0143385 is hereby incorporated by reference in its entirety. A traffic operator is a person who gathers traffic information from a variety of sources, such as by monitoring emergency scanner frequencies, by viewing images from cameras located adjacent to a roadway, and by calling government departments of transportation, police, and emergency services. In addition, the traffic operator may obtain traffic data from aircraft flying over the road network.

The traffic operator may enter event data 116 using TIMS edit screens, which present the traffic operator with a menu to select the type of information entered for a particular type of incident. The TIMS uses a series of forms to prompt the traffic operator for relevant information to be entered. The forms and fields used depend on the type of traffic information to be entered and what type of information is available. For example, the traffic information entered by the traffic operator may be related to weather, an accident, construction, or other traffic incident information.

The traffic data collection center 102 may also have access to historical traffic data 118. The historical traffic data 118 may include travel time, delay time, speed, and congestion data for various times of the day and days of the week. The traffic data collection center 102 may use the historical traffic data 118 to predict clearance time for a traffic event, to predict traffic conditions when sensor data 112, probe data 114, and/or event data 116 is unavailable for a particular roadway, or for any other suitable purpose.

The traffic data collection center 102 includes a combination of hardware, software, and/or firmware that collects the received sensor, probe, event, and historical traffic data 112-118, analyzes the data 112-118, and provides a traffic data output to applications that use traffic data. For example, the traffic data collection center 102 may be a virtual geo-spatial traffic network (VGSTN) as described in U.S. Patent Publication No. 2004/0143385. Other systems for collecting, analyzing, and providing traffic data in a format that can be used by applications may also be used.

The traffic data collection center 102 analyzes sensor data 112 and probe data 114 to determine whether congestion is building, steady, or receding on a roadway. Additionally, the traffic data collection center 102 integrates the sensor data 112 and probe data 114 with the collected event data 116. The integrated data is mapped using a geographic database to produce a virtual traffic network representing traffic conditions on a road network. In one embodiment, the geographic database is a geographic database published by NAVTEQ North America, LLC of Chicago, Ill.

The traffic data collection center 102 provides a traffic data output to the traffic graphics center 104. The traffic data output may be a traffic feed, such as an RSS or XML feed. The traffic graphics center 104 uses the traffic data output and inputs from a user to create a video output for a traffic report that can be used by the television station 120. The traffic graphics center 104 includes a traffic report application 106, a gadget framework 108, and a gadget set 110.

The traffic report application 106 may be the NeXgen television traffic reporting application as described in U.S. Patent Publication No. 2006/0247850, which is assigned to the same assignee as the current application. U.S. Patent Publication No. 2006/0247850 is hereby incorporated by reference in its entirety. Other applications that can create a traffic report using traffic data may also be used.

The traffic report application 106 uses the traffic data output to create data-driven maps and informational graphics of traffic conditions on a road system for display on a video device. With the traffic report application 106, traffic maps and informational graphics do not need to be pre-rendered into movies, thus providing a dynamic view of traffic data on a road system. Specifically, two-dimensional (2D) and three-dimensional (3D) traffic maps and informational graphics change as traffic data changes in real or near real time. Also, with the traffic report application 106, the traffic report is dynamically created to illustrate the traffic data that the user selects.

While the traffic graphics center 104 is depicted in FIG. 1 as a stand-alone entity, it is understood that the traffic graphics center 104 may be co-located with either the traffic data collection center 102 or the television station 120. Additionally, the output from the traffic graphics center 104 may be provided to end users other than the television station 120. For example, the traffic graphics center 104 may provide an output to a web-based application or a mobile application.

II. Traffic Gadgets

A traffic gadget is a standardized dynamic object having dynamic features that the user can place in a virtual world presented in a traffic report. The traffic gadgets are standardized in that a user interacts with different gadgets in a similar fashion to perform functions, such as placing the gadgets in a world and modifying the gadget properties.

The dynamic features include dynamically changing the visual characteristics of the gadget and/or changing the textual data that is presented as the data driving the gadget changes. For example, in FIG. 9, a travel time gadget 902 overlaying a 2D map 904 depicts a travel time of fifteen minutes, with a delay time of three minutes. As the travel time data changes, the gadget 902 changes, for example, by updating the travel time of fifteen minutes to a different numerical number.

Figure 5:
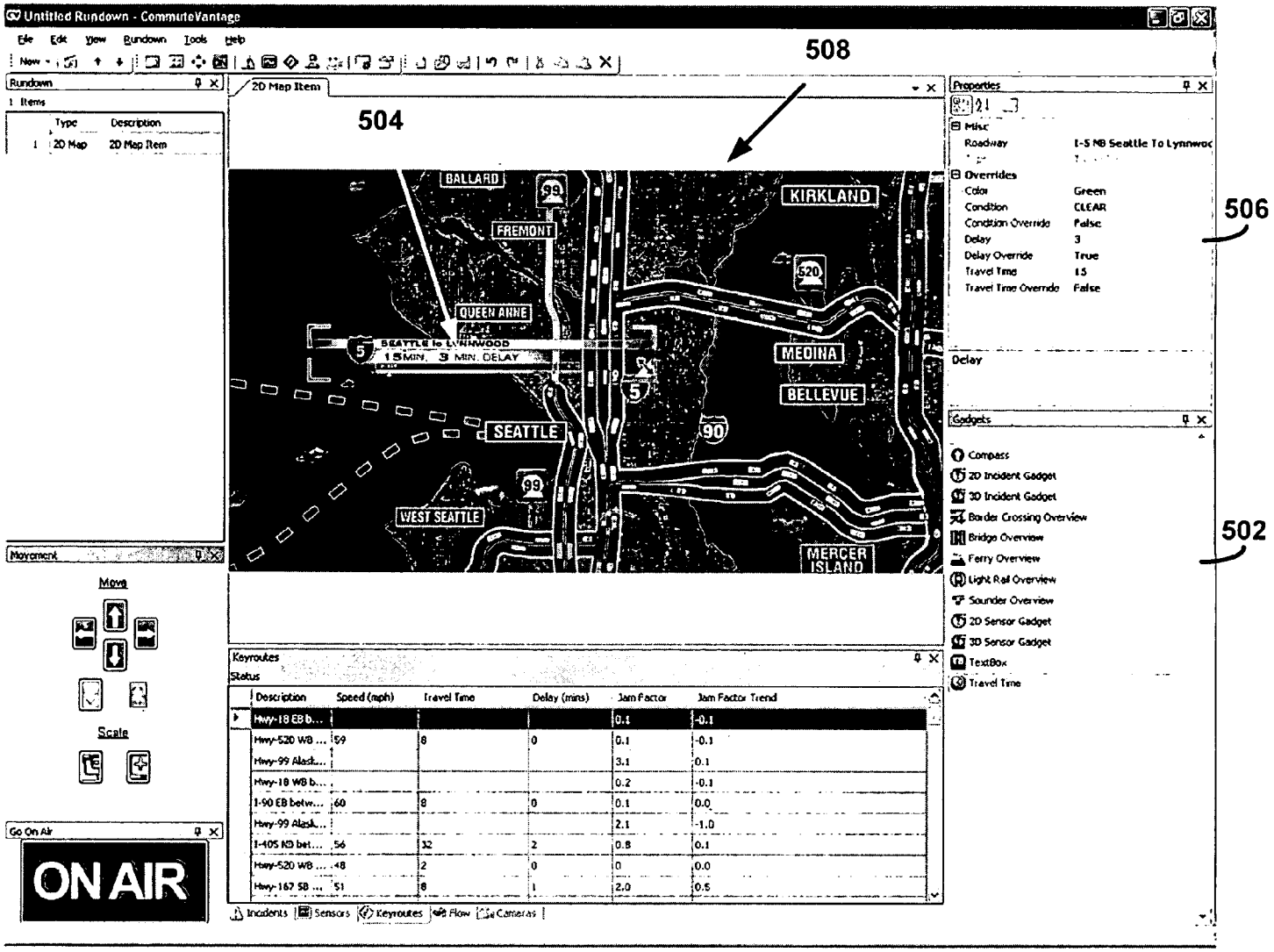
FIG. 5-8 are screen shots depicting a user interface for selecting a gadget for use in a traffic report, according to an example.
Figure 8:
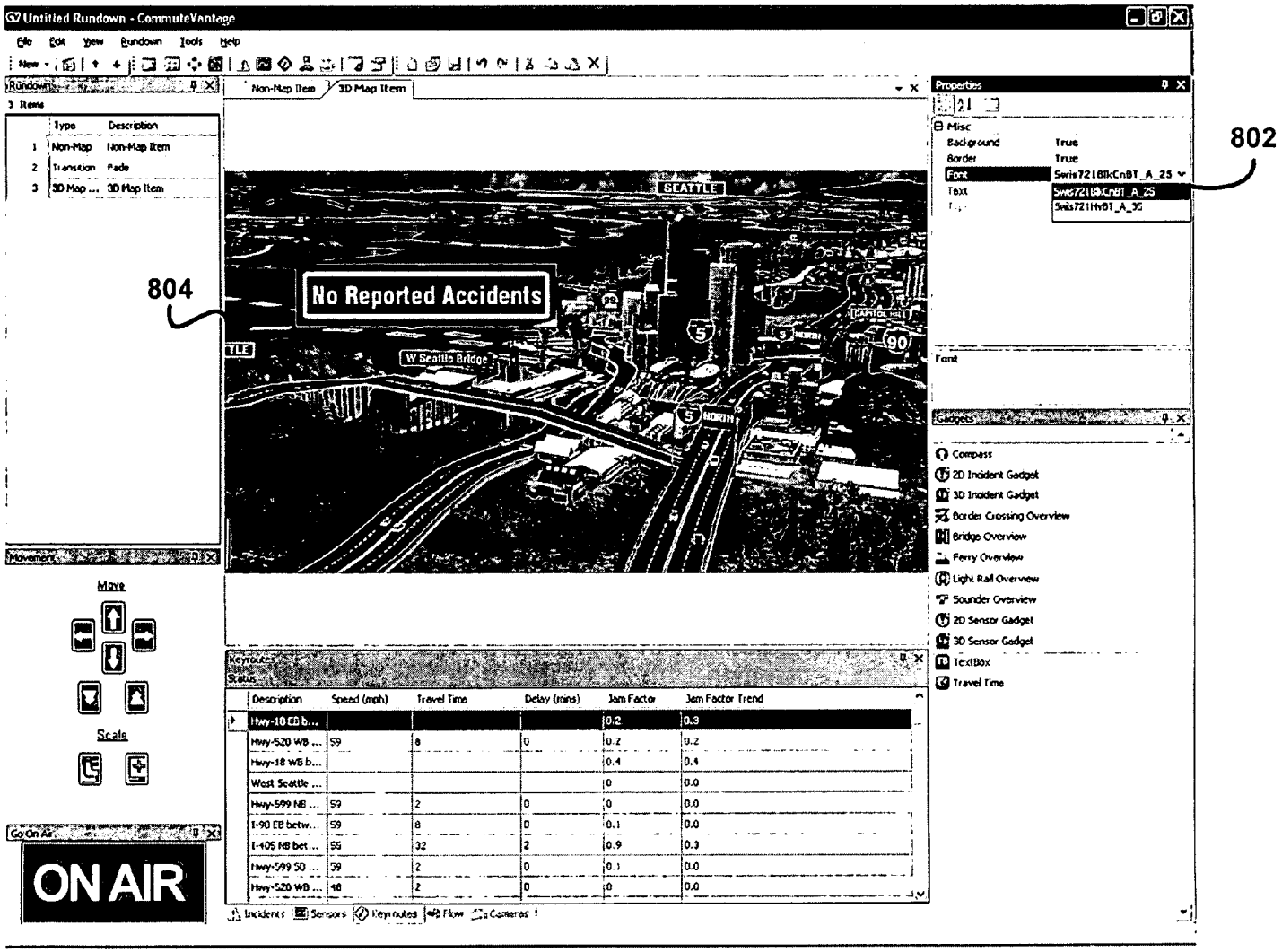
Figure 13:
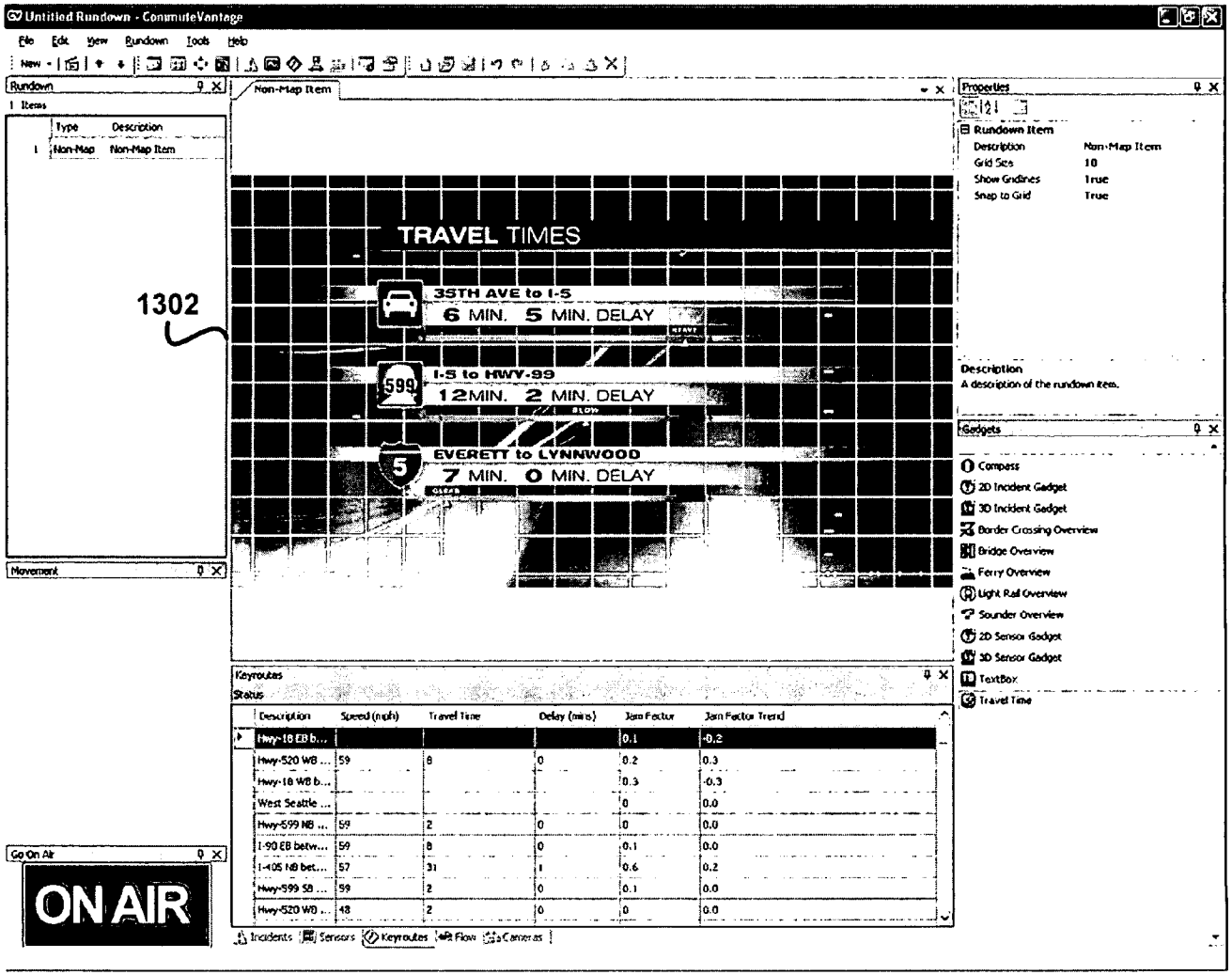
FIG. 13 is a screen shot depicting a user interface for selecting a gadget for use in a traffic report, according to an example.
Figure 15:
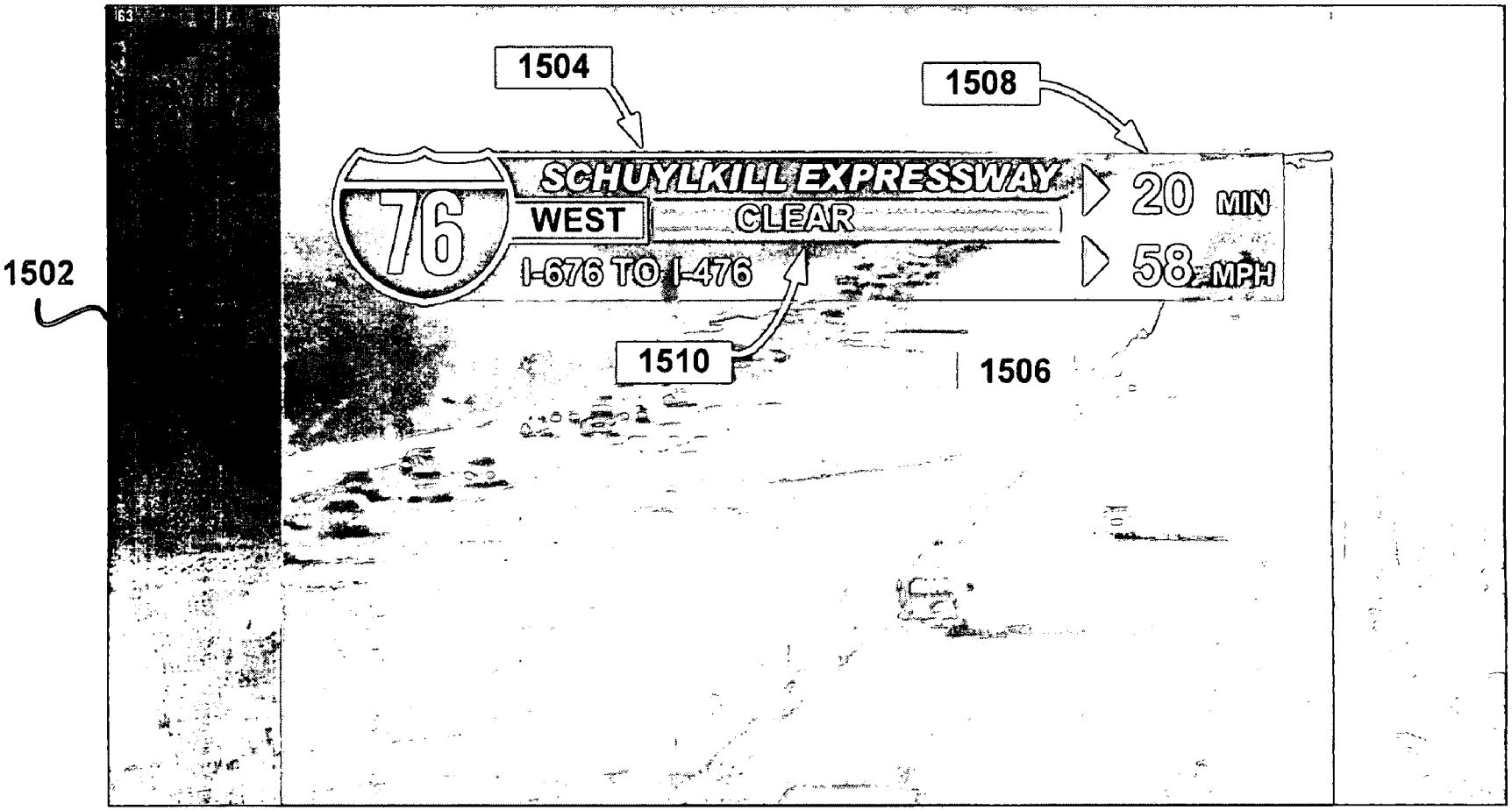
FIG. 15 is a screen shot depicting a travel time traffic gadget overlaying full screen video, according to an example.
Figure 16:
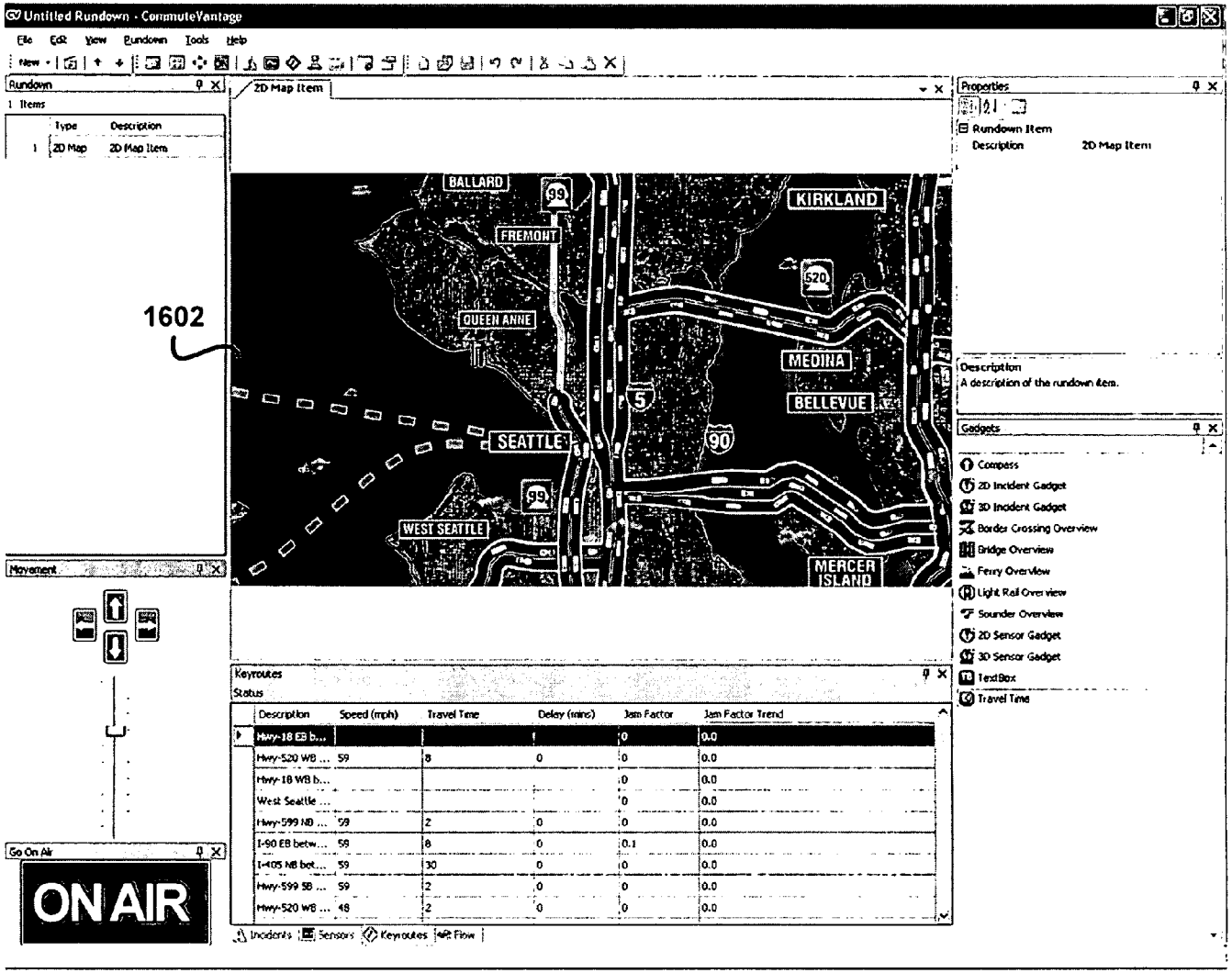
FIG. 16 is a screen shot depicting a user interface for selecting a gadget for use in a traffic report, according to an example.

The traffic gadgets are also dynamic in that they are optionally included and can be included in any location on any type of traffic report item. For example, FIG. 5 depicts a 2D map 508, FIG. 8 depicts a 3D world 804, FIG. 13 depicts an image background 1302, and FIG. 15 depicts a full screen video 1502. The traffic gadgets may be included on other backgrounds as well. It is also understood, that a user may decide not to add a traffic gadget to a traffic report. For example, FIG. 16 shows a 2D map 1602 without gadgets. (Compare with FIG. 5, which shows the same 2D map 508 with the gadget 504 included.)

A traffic gadget is defined by a relatively small code module that is separate from the traffic report application 106. The gadget framework 108 facilitates coding of gadgets according to a set of defined interfaces. Preferably, the gadget framework 108 is implemented using an object oriented design and coding approach. In this example, the gadget framework 108 is implemented as an abstract class that defines required interfaces. The gadget classes that are then developed inherit from the abstract class, forcing them to implement the required interface items. Any number of traffic gadgets can be coded following the framework interface definitions. For a specific television station implementation (or an implementation used at multiple stations), the complete set of gadgets is stored in a code structure referred to as the gadget set 110.

At runtime, the gadget framework 108 provides a uniform set of user interface controls for the user to interact with the traffic gadgets. For example, the gadget framework 108 presents the traffic gadgets available in the gadget set 110 as a gadget palette for the user. An example gadget palette 502 is depicted in FIG. 5. The user interface may identify what traffic gadgets are available in a text listing, a display of icons, a tool bar, or any other user interface mechanism that allows a user to determine what traffic gadgets are available for selection, and to make a selection of traffic gadgets for a traffic report. The user selects from the traffic gadgets that are available and places the selected gadget on the traffic visualization in a uniform way.

The user may also change the runtime properties of the traffic gadgets in a uniform way. The gadget framework 108 provides this ability by presenting a properties grid that shows the properties that are available for the desired traffic gadget and allows the value associated with the property to be changed. An example properties grid 506 is depicted in FIG. 5.

Additionally, the gadget framework 108 renders the visual appearance of the traffic gadget when the gadget is displayed in a traffic report. Thus, the traffic report application 106 displays the virtual worlds and delegates to the gadget framework 108 to display the traffic gadgets that have been placed into the worlds.

III. Programming Traffic Gadgets

Figure 2:
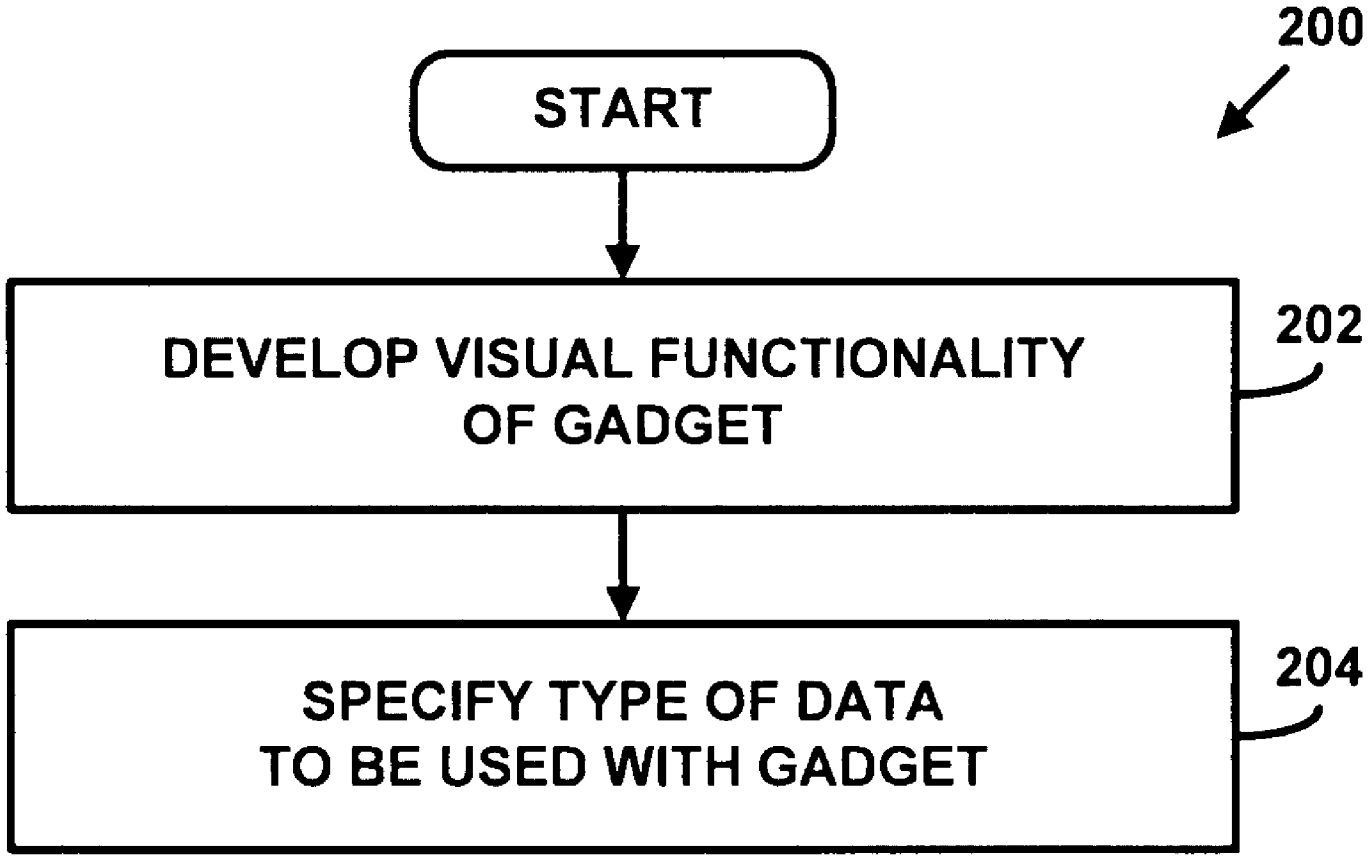
FIG. 2 is a flow chart for programming a traffic gadget, according to an example.

FIG. 2 is a flow chart 200 for programming a traffic gadget. At block 202, a programmer develops code for the basic capabilities of a traffic gadget. The traffic gadget may be designed specifically to provide traffic information in either a 2D or 3D view. Alternatively, the traffic gadget may be used in any view.

For example, the traffic gadget may be designed for one or more of a 2D overhead map, a Skyview map, and a 3D fly-through map as described in U.S. Patent Publication No. 2006/0247850. The 2D overhead map depicts traffic conditions from the perspective of a viewer looking down at a map. The Skyview map is a 3D representation that includes buildings, terrain, and other landmarks. Similar to the 2D overhead map, the Skyview map depicts traffic conditions from the perspective of a viewer looking down at a map. The 3D fly-through map is a dynamic presentation of a 3D world detailing traffic conditions along a selected roadway or series of roadways.

The traffic gadgets may be created without changing the traffic report application 106 software. The traffic gadget implements the functionality specified for gadgets in the gadget framework 108. Additionally, a core set of capabilities that are part of the gadget framework 108 may be used to create the traffic gadget if the default behavior is sufficient. The programmer develops the static and the dynamic features of the traffic gadget. For example, the programmer may select the texture, color, illumination, position, text, and/or other features of the traffic gadget to dynamically change during a traffic report.

At block 204, the programmer specifies the type or types of data that the traffic gadget can receive. For example, the programmer may select one or more of traffic flow data, speed data, volume data, density data, travel time data, incident data, and so on for the traffic gadget. This data drives the variables that control the gadget's dynamic features. Additionally, the programmer specifies whether the traffic gadget uses the received data to provide additional information regarding a traffic incident. For example, the programmer may design a traffic gadget to receive incident data and, based on what incident data is received, provide alternative route information.

Figure 9:
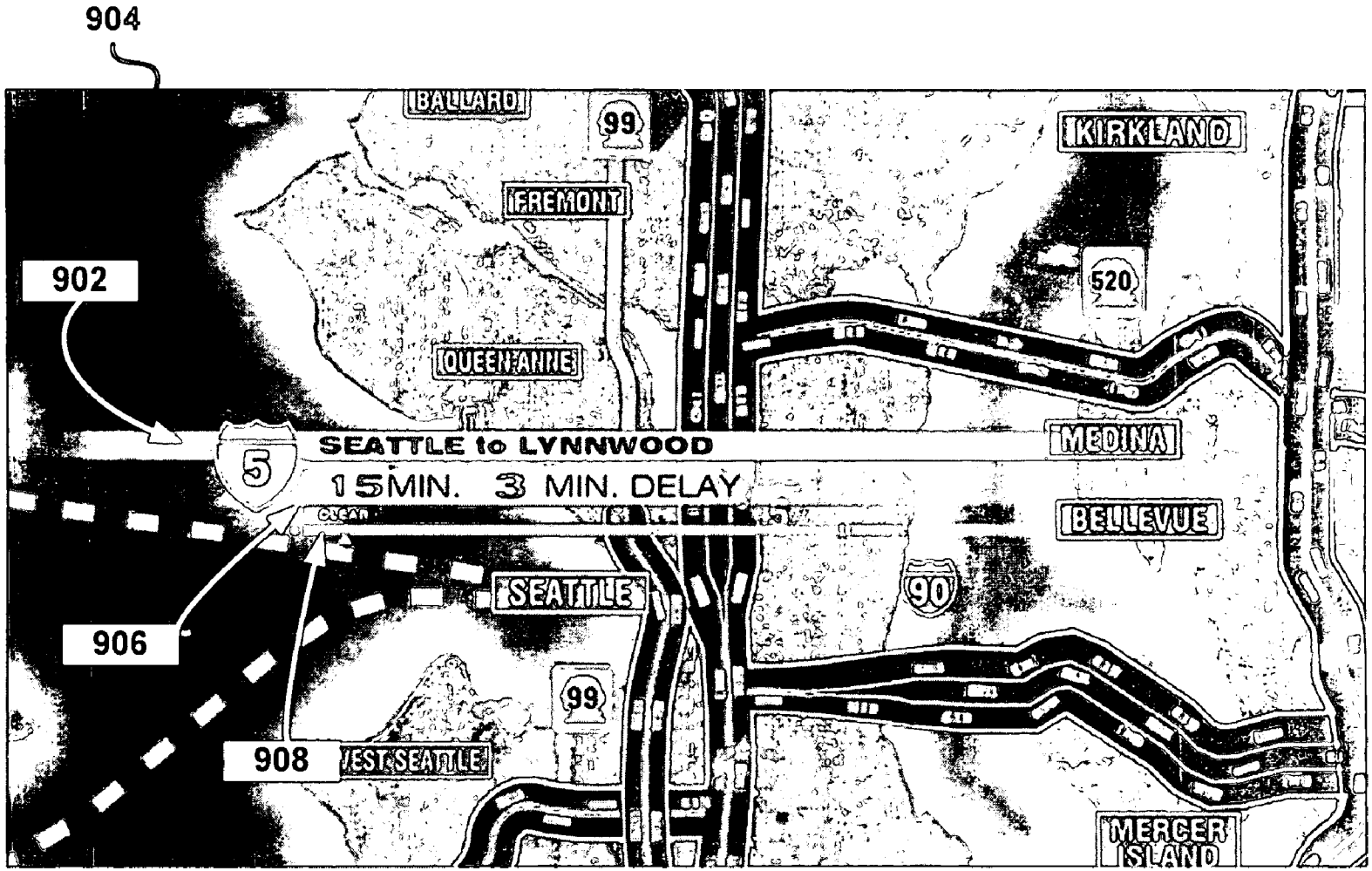
FIG. 9 is a screen shot depicting a travel time traffic gadget overlaying a 2D map, according to an example.

There are various types of data that a traffic gadget can receive and use. For example, FIG. 9 shows a travel time gadget 902 that displays numeric textual data 906 for the travel time and amount of delay along a section of roadway. The travel time gadget 902 also displays a qualitative representation 908 of the traffic conditions by showing an image signifying a clear condition. These elements 906, 908 change as the traffic conditions change.

Figure 10:
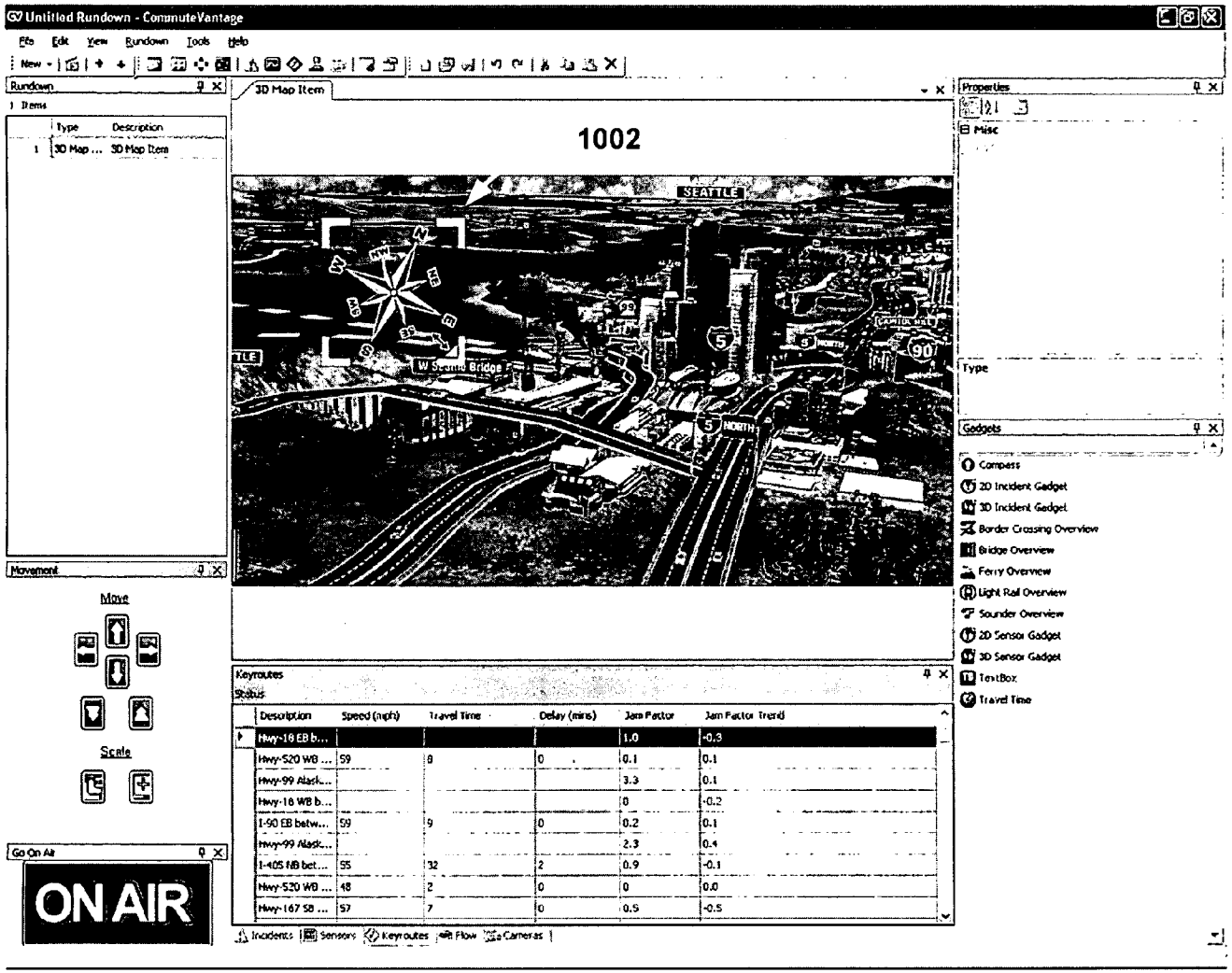
FIGS. 10-11 are screen shots depicting a selection of a compass traffic gadget via a user interface, according to an example.
Figure 11:
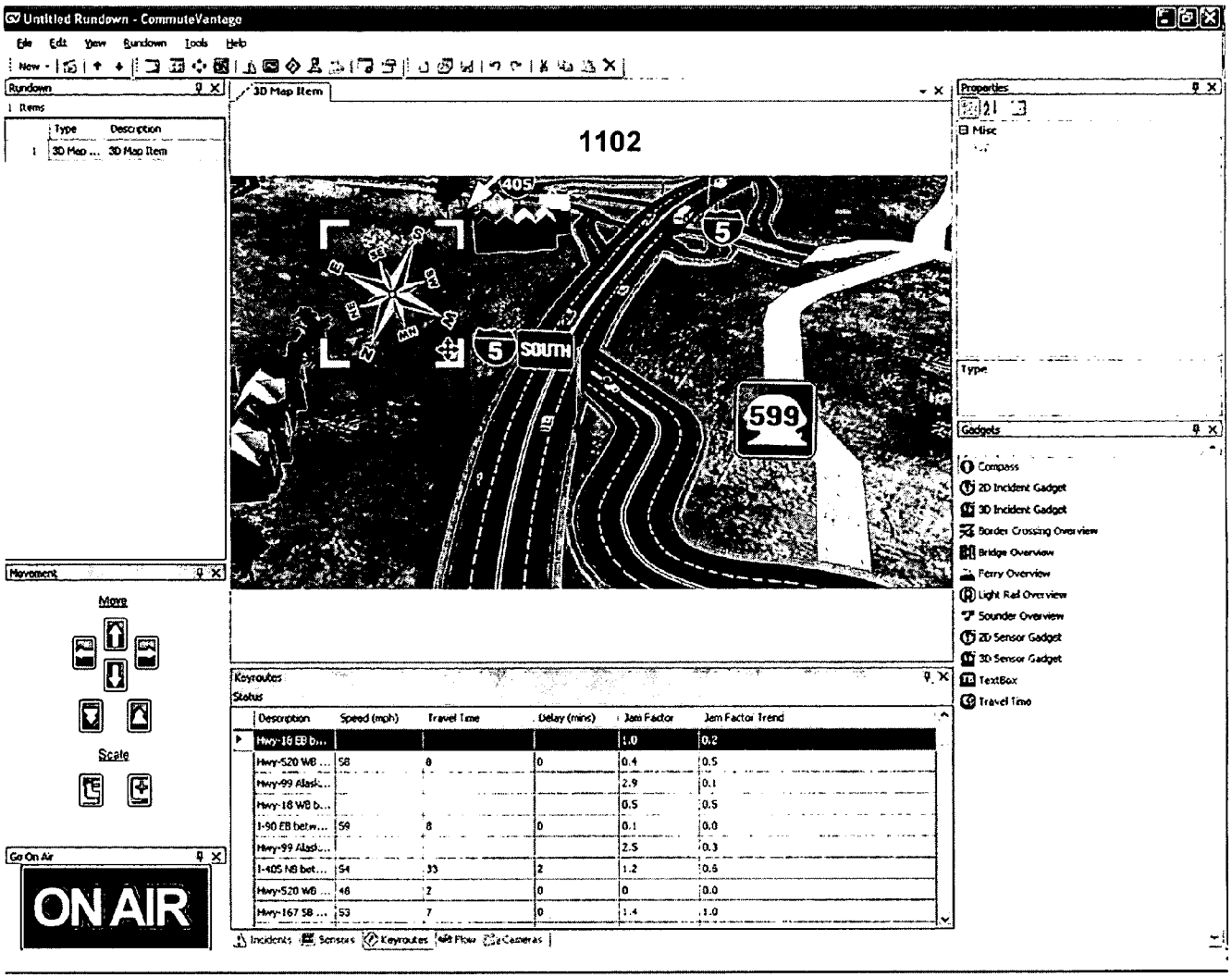

As another example, FIG. 10 shows a compass gadget 1002 placed in a 3D world. The compass gadget 1002 is driven based on a direction that a virtual camera is pointing in the 3D world. The camera in FIG. 10 is roughly pointing north and, as a result, the compass gadget 1002 spins so that the gadget 1002 is also pointing north. In FIG. 11, the virtual camera is roughly pointing south. As a result, the compass gadget 1102 spins so that the gadget 1102 is also pointing south.

Figure 12:
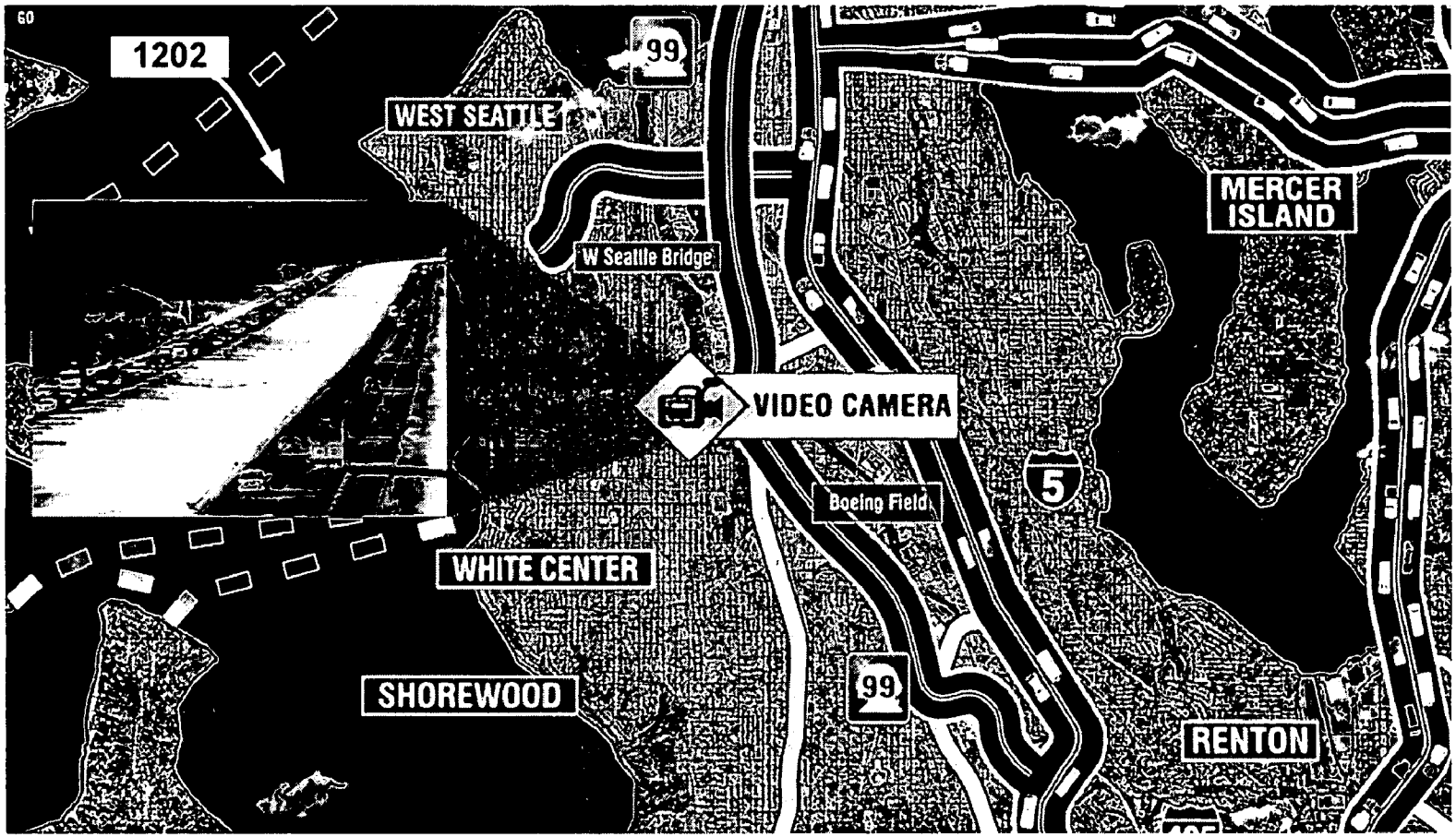
FIG. 12 is a screen shot of a video feed gadget overlaying a 2D map, according to an example.

FIG. 12 shows yet another type of data driving a traffic gadget. In this example, a video feed gadget 1202 is driven by camera location data and video feed data. The video feed gadget 1202 may be used to show video content and mark the location of the video content on a map.

IV. Configuring Traffic Gadgets

Figure 3:
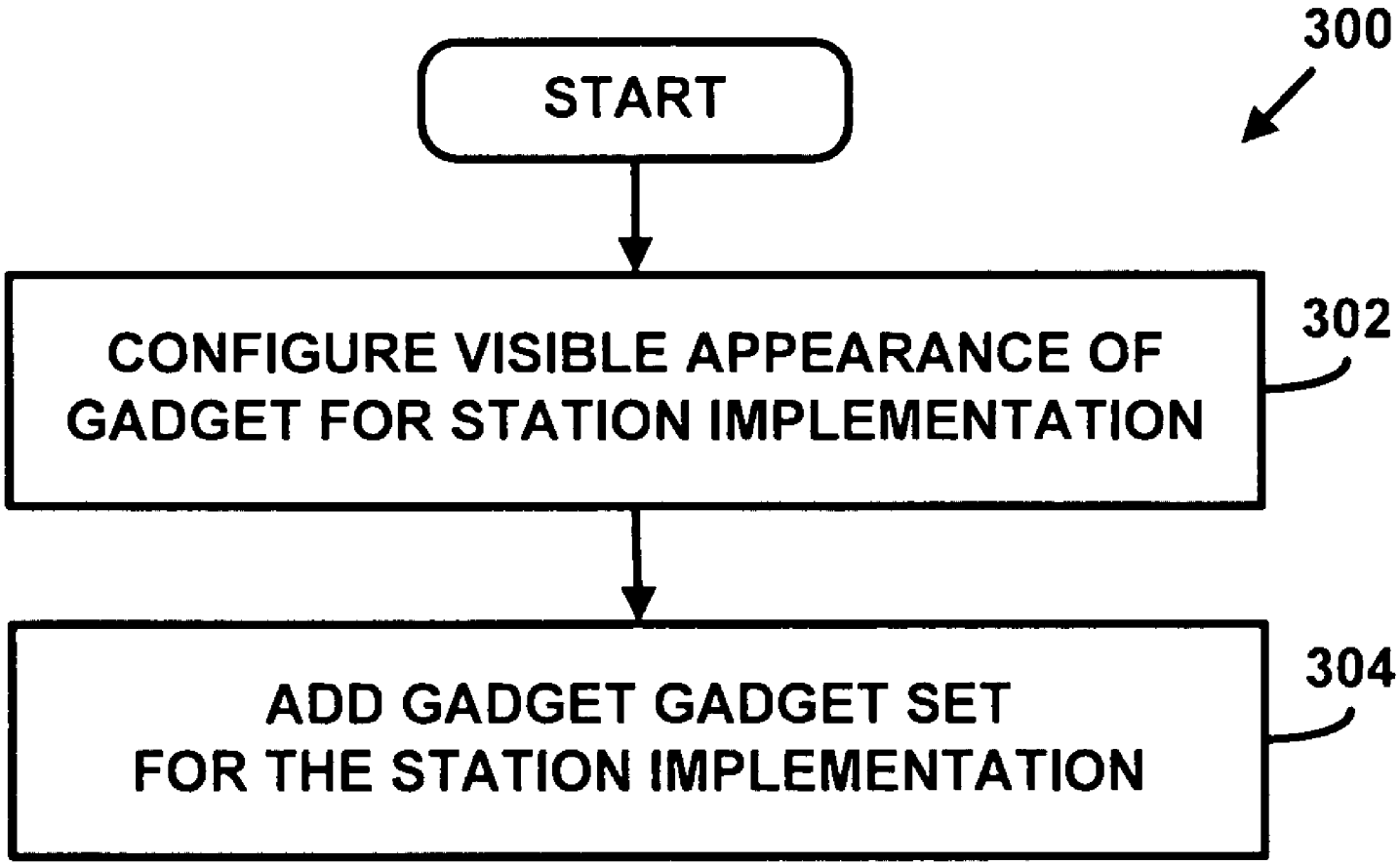
FIG. 3 is a flow chart for configuring a traffic gadget, according to an example.

FIG. 3 is a flow chart 300 for configuring a traffic gadget. As described with reference to FIG. 2, the programmer creates the basic capabilities of the traffic gadget. Then, for a specific television station (or multiple television stations), an artist configures the artwork for the traffic gadget at block 302. The programmer and the artist may be the same or a different person. The artist configures the visible appearance of the traffic gadget and selects data to drive the gadget's dynamic functionality from the available data.

Figure 14:
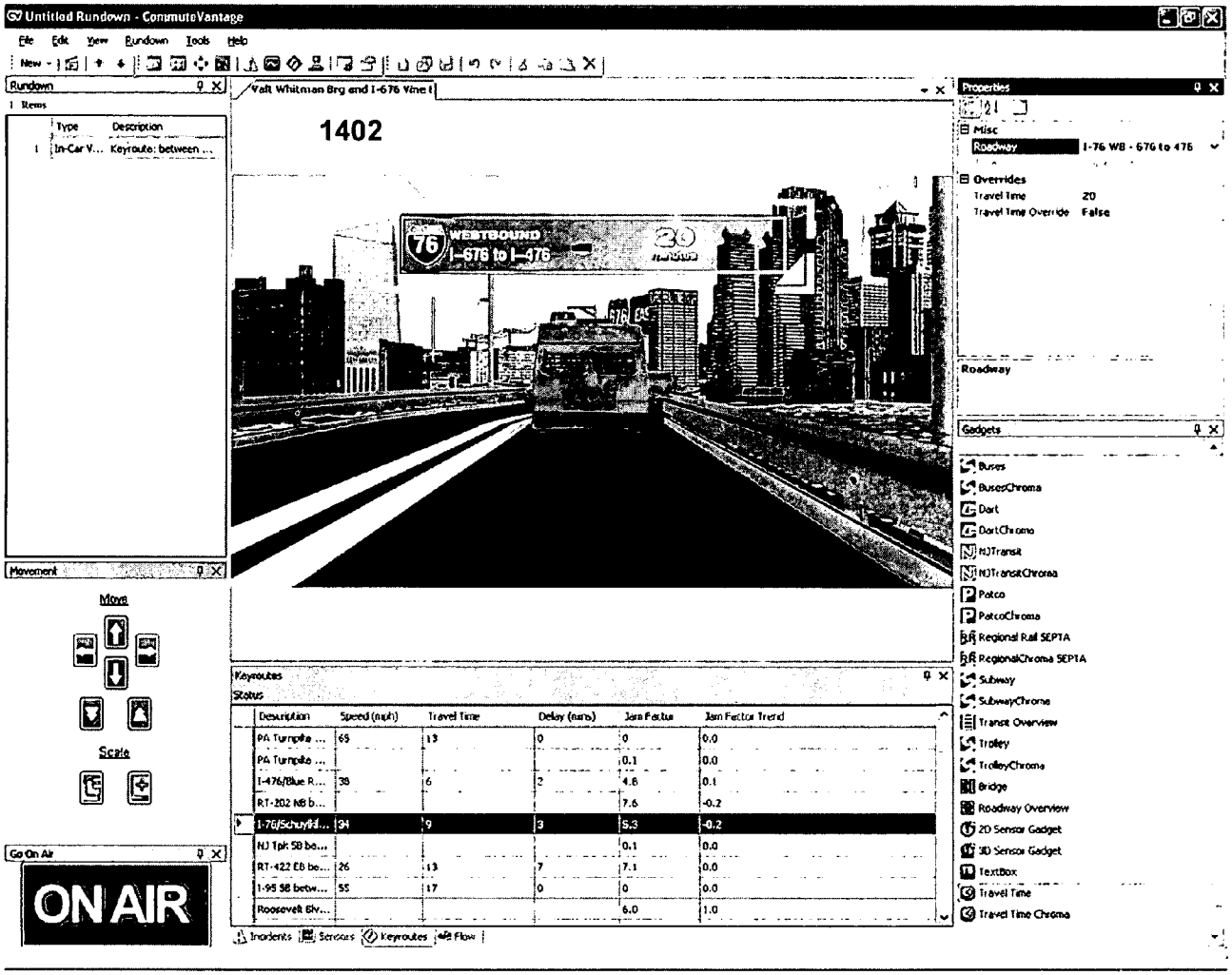
FIG. 14 is a screen shot depicting a user interface for selecting a gadget for use in a traffic report, according to an example.

Obviously, the artist does not have to use all the data that is available. For example, FIG. 9 shows the travel time gadget 902 on a 2D map 904 and shows the travel time data, the delay time data, and a qualitative assessment of the conditions (e.g., "clear," "slow," etc.). FIG. 14 shows a travel time gadget 1402 used by a different television station. As seen by comparing FIG. 14 to FIG. 9, the travel time gadget 1402 is different than the travel time gadget 902 in both static image content and the dynamic data. The travel time data is included in the gadget 1402, but the delay data and the qualitative graphic are not used in the gadget 1402.

FIG. 15 shows a travel time gadget 1504 as used by yet another television station. The travel time gadget 1504 again shows different static and dynamic content from the travel time gadget 902 and the travel time gadget 1402. In this example, the travel time gadget 1504 is configured to use the average speed 1506, the travel time 1508, and the qualitative content 1510.

The artist may use a graphics application, such as commercially available Autodesk® 3ds Max® (formerly 3D Studio MAX), to create the traffic gadget artwork. Another application, such as Gamebryo, may be used to create a runtime graphics data file (e.g., a .nif file) used by the traffic graphics center 104 to create the video output sent to the television station 120 or other end user.

At block 304, the artist adds the completed gadget to the gadget set 110. Because the artist is not limited by the visible appearance or the type of data controlling the dynamic features of the traffic gadget, the same gadget can look very different at various station implementations as described with reference to FIGS. 9, 14, and 15. The number and type of traffic gadgets in the gadget set 110 may be selected based on a particular user's needs.

V. Using Traffic Gadgets

Figure 4:
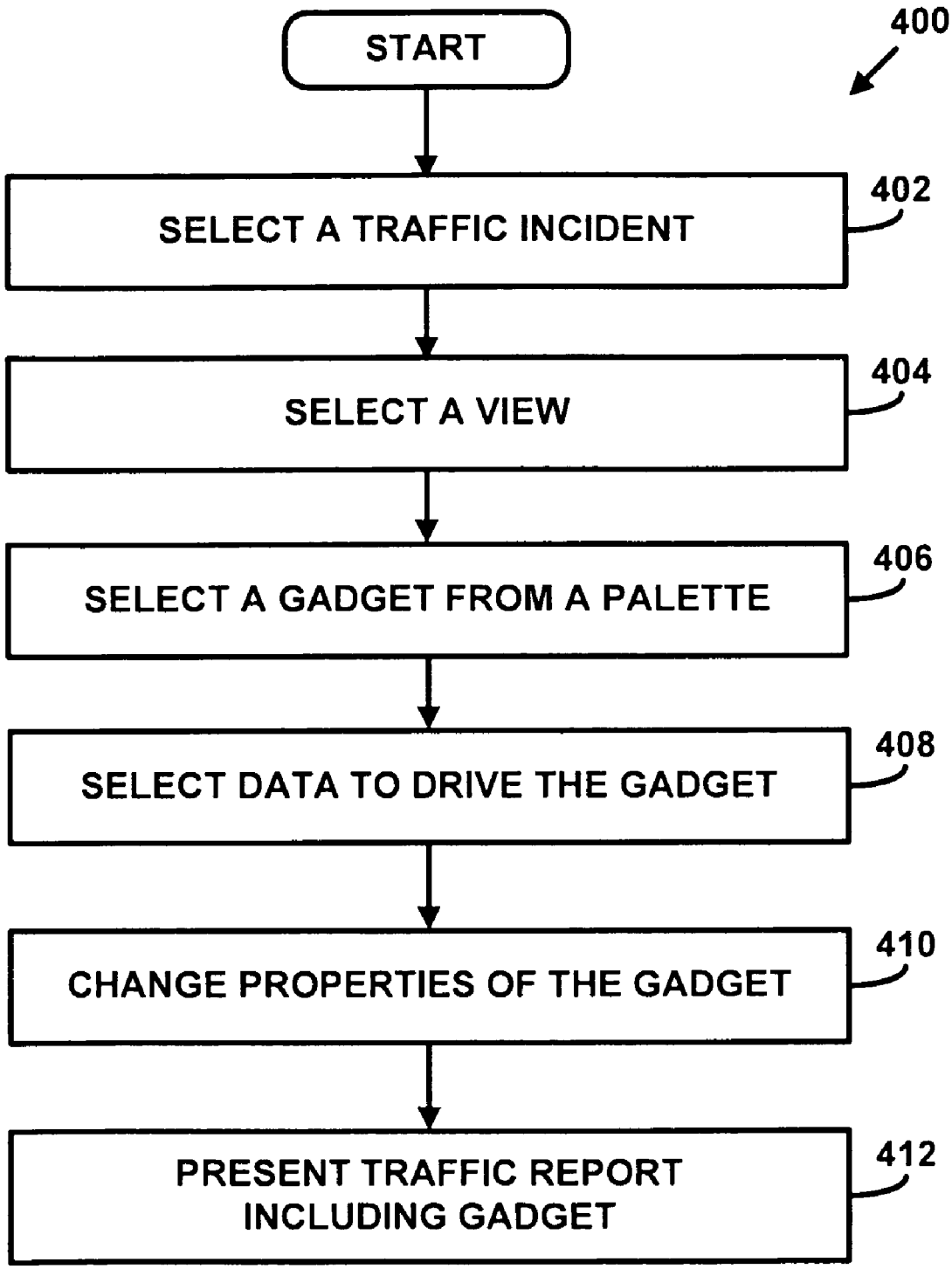
FIG. 4 is a flow chart for selecting a traffic gadget for use in a traffic report, according to an example.

FIG. 4 is a flow chart 400 for using a traffic gadget in a traffic report. At block 402, a user, such as a television producer, optionally selects a traffic incident to present in a traffic report. The user selects a traffic incident with a user interface. For example, the user interface may allow the user to highlight and click the traffic incident from a list of incidents using a computer mouse. Other user interface designs and input devices may also be used. The user may also decide not to select a traffic incident and start the flow chart 400 at block 404.

At block 404, the user selects a view or series of views for the traffic report in a similar manner as selecting an incident. For example, via the user interface, the user may select one or more of a 2D overhead map view, a Skyview map view, and a 3D fly-through map view. The user may also select a start point and an end point for the 3D fly-through map view. The view may be based on an incident or a desire to show a particular region of the metro area.

At block 406, the user selects one or more gadgets from a gadget palette in a similar manner as selecting an incident and the views. The user selects whether the traffic gadget overlays a map or is incorporated into a 3D world. FIG. 5 shows a screen shot of the application including the gadget palette 502. The user also selects what views display the selected gadgets. For example, if the user selects a series of views at block 404, the user can also select whether the traffic gadgets are placed on one, some, or all of the views.

Figure 6:
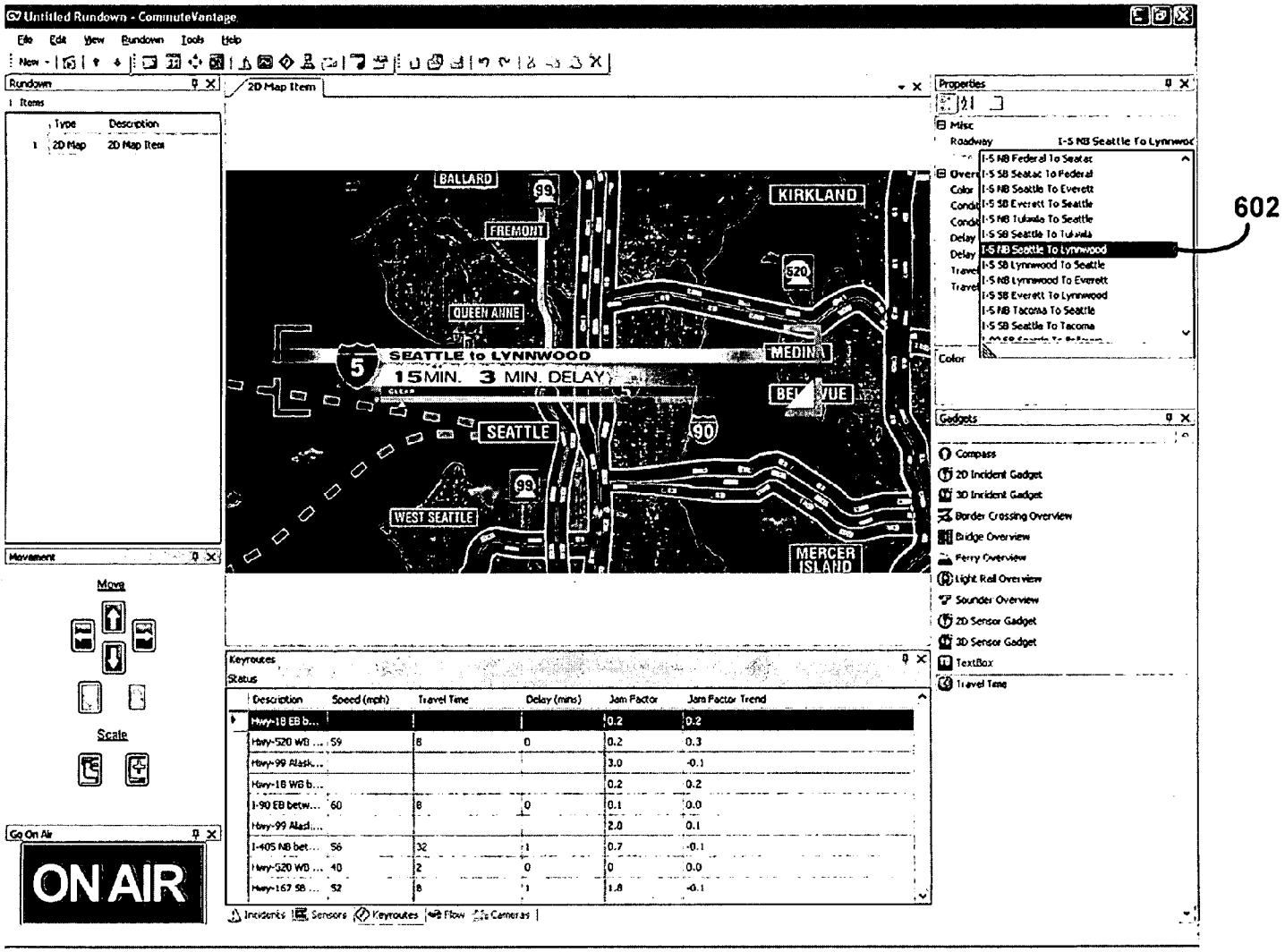
Figure 7:
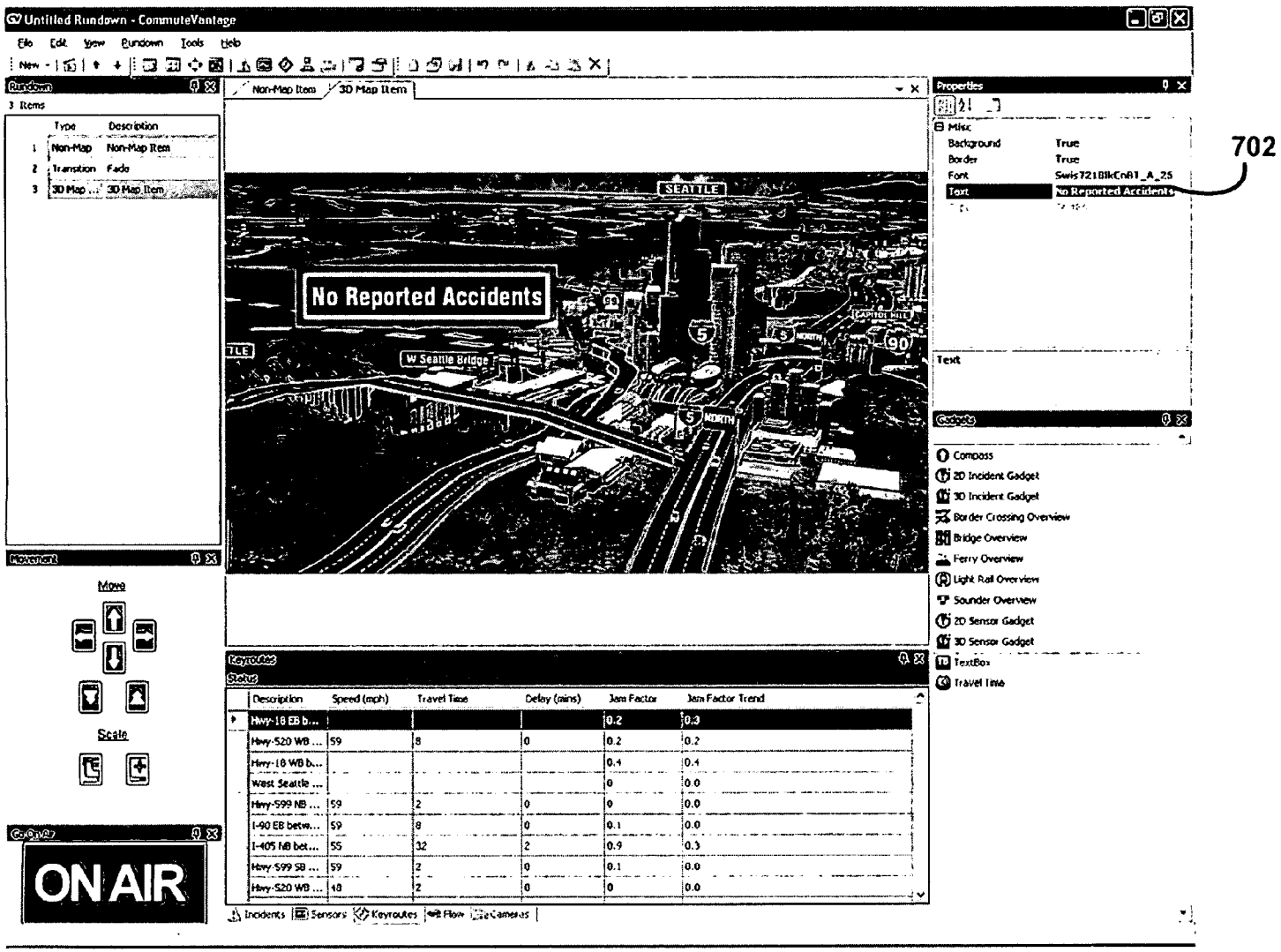

At block 408, the user optionally selects data to drive or otherwise control the functionality of the traffic gadget in a similar manner as selecting an incident, the views, and the traffic gadgets. For example, if the traffic gadget has been designed to accept speed data, the user specifies that the traffic gadget uses the speed data from a specified point on a road. For each gadget selected, the user interface may display a list of data sources from which the user can select to drive the traffic gadget. This is done using the gadget properties grid 506. FIG. 6 shows the user selecting the data to drive the gadget from the list of choices that are available 602. Additionally, the user interface may include a text input area 702 for traffic gadgets that have free form text functionality as depicted in FIG. 7. For some traffic gadgets, such as a compass gadget, the user does not need to select data to drive the gadget.

At block 410, the user may change the properties of the gadget. As shown in FIG. 8, the user may change the properties of the gadget using the gadget properties grid 802. For the example shown in FIG. 8, the user changes the font property for the free form text in the gadget 804. Of course, the user may decide not to change gadget properties.

At block 412, the television station 110 or other end user presents the traffic report for viewing. The on-air appearance would look like FIG. 9, for example, with the traffic gadget overlaying the selected view. The traffic graphics center 104 obtains traffic data from the traffic data collection center 102 and uses the traffic data to calculate the status of each of the road segments. The traffic graphics center 104 also uses the traffic data to drive the functionality of the selected traffic gadgets. The user also has the ability to manually change a traffic gadget's properties. For example, the user can override malfunctioning data points or manually provide data when a data feed is interrupted.

The traffic report includes a traffic flow map that shows current traffic conditions, preferably using a color-coded animation of vehicles moving along a roadway. The animation is representative of the current speed, volume, and density of the current traffic conditions along the roadway. For example, cars depicted on a segment of the traffic flow map may move at a rate representative of the actual roadway speed for the segment. Additionally, the number of cars may represent the actual volume of cars on the segment and the color of the cars may represent the actual density of the segment.

The traffic flow map is placed in a 2D and/or a 3D world. The user-selected traffic gadgets overlay the traffic flow map and/or are placed within the world. The traffic flow map and the traffic gadgets are visible to a viewer of the traffic report.

Beneficially, the user is able to select what gadgets to use in a traffic report and optionally the data to control the traffic gadget. Additionally, the traffic gadgets can be part of a 2D or a 3D world. For gadgets placed in the 3D world, the traffic report can include a fly-through map view in which a camera flies to the traffic gadget. As a result of having a gadget palette, the user has much more flexibility in formatting a traffic report to be presented by the television station 120, by web-based applications, by mobile applications, and so on.

Additionally, the artist may have more flexibility configuring a traffic gadget for a television station based on how the programmer programs the basic capabilities of the gadget. For example, the programmer may develop code for a traffic gadget (a "universal traffic gadget") that allows the artist to configure the static and dynamic features of the traffic gadget. As an example, the artist may specify the type or types of data that the traffic gadget can receive, such as speed data, volume data, density data, travel time data, and incident data. The artist may then also select the texture, color, illumination, position, text, and/or other features of the traffic gadget to dynamically change during a traffic report. As a result, the universal traffic gadget may be the only traffic gadget needed for creating a gadget set 110 for the television station.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

We claim:

1. A method of generating a traffic report that includes a visual depiction of a geographical area including a portion of a road network located therein, comprising:

providing a selection of views for a visual traffic report in a user interface;

providing a selection of traffic gadgets in the user interface;

receiving from a user of the user interface a selection of at least one view and a selection of at least one traffic gadget; and creating the visual traffic report including the at least one traffic gadget placed in the at least one view.

2. The method of claim 1, further comprising providing a selection of data for controlling the at least one traffic gadget.

3. The method of claim 2, further comprising receiving from the user the selection of data for controlling the at least one traffic gadget.

4. The method of claim 3, wherein creating the visual traffic report further comprises using the data for controlling the at least one traffic gadget.

5. The method of claim 1, further comprising providing a selection of traffic incidents.

6. The method of claim 5, further comprising receiving from the user the selection of at least one traffic incident.

7. The method of claim 6, wherein creating the visual traffic report further comprises using data representing the at least one traffic incident in the visual traffic report.

8. The method of claim 1, further comprising providing a selection of placement of the at least one traffic gadget in the at least one view.

9. The method of claim 8, further comprising receiving from the user the selection of placement of the at least one traffic gadget in the at least one view.

10. The method of claim 9, wherein the at least one traffic gadget overlays a traffic map.

11. The method of claim 9, wherein the at least one traffic gadget is placed in a 3D world.

12. A system of generating a traffic report that includes a visual depiction of a geographical area including a portion of a road network located therein, comprising:

a traffic data collection center that receives data regarding traffic conditions on at least one roadway in the portion of the road network and generates a traffic data output; and a traffic graphics center that receives the traffic data output from the traffic data collection center and user selections of a traffic gadget and data that determines appearance of the traffic gadget in a traffic report, wherein the traffic graphics center provides an output to generate the traffic report including the traffic gadget.

13. The system of claim 12, wherein the data that determines appearance of the traffic gadget in the traffic report includes data representing a traffic incident.

14. The system of claim 12, wherein the data that determines appearance of the traffic gadget in the traffic report includes data representing a view.

15. The system of claim 14, wherein the data that determines appearance of the traffic gadget in the traffic report includes data that determines placement of the traffic gadget in the view.

16. The system of claim 12, wherein the data that determines appearance of the traffic gadget in the traffic report includes data that drives the traffic gadget.

17. A method for providing a set of traffic gadgets for use in a traffic report that includes a visual depiction of a geographical area including a portion of a road network located therein, comprising:

configuring a visible appearance of a traffic gadget such that the visible appearance of the traffic gadget has an ability to change during a traffic report;

selecting at least one type of data that the traffic gadget can receive, wherein the selected data type controls the changing visible appearance of the traffic gadget;

adding the traffic gadget to a gadget set; and providing a gadget palette to a user for selecting the traffic gadget from the gadget set for placement in a visual traffic report.

18. The method of claim 17, wherein configuring the visible appearance of the traffic gadget includes selecting at least one of texture, color, illumination, position, and text of the traffic gadget.

19. The method of claim 17, wherein selecting at least one type of data that the traffic gadget can receive includes selecting at least one of traffic flow data, speed data, volume data, density data, travel time data, and incident data.

20. The method of claim 17, further comprising customizing the gadget set for a television station.

* * * * *